United States Patent [19]

Baralis et al.

[11] Patent Number: 4,755,233

[45] Date of Patent: Jul. 5, 1988

[54] HEAT TREATMENT PROCESS FOR STAINLESS STEEL WIRE ROD

[75] Inventors: Giovanni Baralis, Turin; Fabio Guglielmi, Rome; Giovanni Lanfranco, Saint Vincent, all of Italy

[73] Assignee: Centro Sperimentale Metallurgico SpA, Rome, Italy

[21] Appl. No.: 886,101

[22] Filed: Jul. 16, 1986

[30] Foreign Application Priority Data

Aug. 1, 1985 [IT] Italy ..... 48439 A/85

[51] Int. Cl.[4] ..... C21D 8/06

[52] U.S. Cl. ..... 148/12 B; 148/12 E; 148/12 EA; 148/135; 148/136

[58] Field of Search ..... 148/12 B, 12 E, 12 EA, 148/135, 136

[56] References Cited

U.S. PATENT DOCUMENTS

| | | | |
|---|---|---|---|
| 4,528,046 | 7/1985 | Yamamoto et al. | 148/12 E |
| 4,619,714 | 10/1986 | Thomas et al. | 148/12 B |

FOREIGN PATENT DOCUMENTS

| | | | |
|---|---|---|---|
| 56120 | 5/1978 | Japan | 148/12 B |
| 91944 | 7/1980 | Japan | 148/12 EA |
| 47835 | 5/1982 | Japan | 148/12 B |
| 161022 | 10/1982 | Japan | 148/135 |
| 193318 | 11/1983 | Japan | 148/12 E |
| 69917 | 5/1986 | Japan | 148/12 EA |

*Primary Examiner*—John P. Sheehan
*Assistant Examiner*—George Wyszomierski
*Attorney, Agent, or Firm*—Young & Thompson

[57] ABSTRACT

A process for heat treatment of austenitic and ferritic stainless steel wire rod, comprising rolling a stainless steel wire rod with a finishing-rolling temperature (FRT) between 850° C. and 1050° C. The rod is then held at a temperature between FRT −50° C. and FRT +100° C. for 15 to 30 minutes, and is then wire cooled. For the manufacture of austenitic stainless steel wires for the manufacture of springs, the finishing rolling temperature is 1000°-1050° C., followed immediately by water cooling.

2 Claims, No Drawings

HEAT TREATMENT PROCESS FOR STAINLESS STEEL WIRE ROD

This invention concerns a heat treatment process for stainless steel wire rod. More precisely it concerns the method of treating the wire rod immediately after it has been hot rolled.

In conventional treatment processes, after rolling, stainless steel wire rod is subjected to uncontrolled cooling in air to room temperature, then heated to high temperature, held for thirty to one hundred and twenty minutes at the maximum soaking temperature and then water cooled.

The reasons for this treatment are known to the experts, so it would be superfluous to repeat and comment on them here.

It is interesting, instead, to note that while this treatment ensures a high-quality product, it is very lengthy and utilizes large quantities of energy, and moreover it often gives a product whose quality is considerably higher than that really needed for the ensuing treatments or the desired final product.

A great many proposals have thus been put forward for simpler, shorter and especially less energy-wasteful treatments. However, each of these perfected treatments takes account of only one final product need, so they are all different from one another.

Thus, for example, German Patent Application No. 2 824 393 concerns austenitic stainless steel wire rod, which is rolled with a finishing rolling temperature of 700°-750° C., then immediately subjected to controlled cooling in air and/or water, so as to prevent grain growth which could reduce the mechanical strength of the wire. Air cooling is used when it is wished to avoid excessive hardening of the wire.

Unexamined Japanese Patent Application No. 80-164036 concerning austenitic stainless steel wire rod indicates that the finishing-rolling temperature should be above 1000° C., after which the material is quenched to below 500° C., again with a view to preventing grain growth.

Belgian Patent No. 885 093 again concerning austenitic stainless steel, requires that the grain should grow to between ASTM 3 and 7 in size; finishing rolling temperature is above 1100° C., the wire rod being held there to favour grain growth, after which it is cooled rapidly. This treatment is designed to ensure better cold deformability.

Unexamined Japanese Patent Application No. 81-166335 describes a ferritic stainless steel wire rod treatment where, after rolling, the material is held between 740° and 820° C. for at least five minutes, making sure anyway that the temperature does not fall below 650° C., then it is cooled rapidly in water. The purpose of this treatment is to allow complete formation of carbides (including chromium) of the $M_{23}C_6$ type, to permit diffusion of the chromium towards the impoverished sites, and to prevent precipitation of carbides of the $M_7C_3$ type that form around 600° C., the temperature at which diffusion of chromium starts to be insufficiently rapid.

As is evident from this very succinct review of the state of the art, final needs are quite diversified and call for very different treatment temperatures and times. Since in actual fact none of these plants has the built-in capacity to allow marked changes in operating parameters, it will be readily appreciated that when it is necessary to diversify and specialize wire-rod manufacturing conditions there are major difficulties, with the state-of-the-art schemes in performing all treatments with the same plant. Similarly, it is difficult or impossible to organize a production mix that does not call for continuous, excessive adjustments of process conditions.

The present invention is designed to overcome these difficulties by providing one simple process that permits treatment of both austenitic and ferritic steels.

Another object of this invention is to provide a process that is simple but which with small adjustments is capable of customizing the product to suit subsequent processing needs.

According to the present invention, the wire rod is rolled with a finishing rolling temperature (FRT) of between 850° and 1050° C., and is then held for a period of up to thirty minutes at between FRT−50° C. and FRT+100° C., after which it is water cooled.

The extreme finishing rolling temperatures, namely 850° C. and 1050° C. are reserved, of course, for ferritic and austenitic steels, respectively. However, a restricted temperature range around 950° C. can be considered suitable for finishing rolling both austenitic and ferritic steels.

Another interesting point is that the final treatment is the same in all cases, namely water cooling. In fact it has been surprisingly found that with ferritic steels the treatment process is such as to reduce holding times from the previous one-to-two hours to between fifteen and thirty minutes, namely the same range that proves suitable for austenitic steels.

The time the wire rod is held at high temperatures between finishing rolling and water cooling is, in fact, an extremely important feature of the process. With most ferritic steels, this soak serves essentially to permit complete precipitation and spheroidization of the chromium carbides and to allow rediffusion of the chromium towards the zones adjacent to the carbides, thus conserving the corrosion-resistance properties which are otherwise damaged by local impoverishment in chromium caused by precipitation of the carbides.

Moreover, with AISI 430 steel in particular, the treatment is also designed to favour transformation of the austenite generally present at the FRT into ferrite, thus ensuring the desired mechanical properties.

In the case of austenitic steels the soak serves essentially to permit some grain growth needed to secure good cold formability (for heavy drawing, bolt-making, etc.).

By limiting the holding time to thirty minutes austenitic steels and ferritic steels can be treated in a single continuous furnace in line with the rolling mill.

No mention has been made of the minimum treatment time. This is quite intentional. For austenitic steels, this time may well be considerably less than thirty minutes, and even as low as two or three minutes while still ensuring the desired grain growth, when the finishing rolling temperature is kept towards the upper end of the range mentioned.

It is also possible that grain growth is definitely undesirable, as with austenitic steel for springs and/or for wire not excessively drawn, for instance. In this case control rolling is terminated at between 1000° and 1050° C. and the wire rod is water cooled before it has cooled by as much as 50°-100° C.

The invention will now be further described by a number of embodiments reported below by way of exemplification without limiting the invention or claims thereto.

EXAMPLE 1

A 5.5 mm diameter wire rod of AISI 304 steel (C 0.055%, Cr 18.6%, Ni 8.8%) was hot rolled with a finishing rolling temperature of 980° C. It was then treated in the following ways:

(A) Air cooled (B) Air cooled; heated to 1080° C. and held for sixty minutes; water cooled (C) Placed immediately in furnace at 1050° C. and held for thirty minutes; water cooled.

The properties of the products obtained are set forth in Table 1.

TABLE 1

| | R(MPa) | $R_s$(MPa) | A % | Z % | ASTM grain n° | Intergranular corrosion rate mm/yr | Drawability % |
|---|---|---|---|---|---|---|---|
| A | 700 | 304 | 67 | 76 | 11 | 0.90 | Broke |
| B | 600 | 220 | 77 | 80 | 5 | 0.21 | 93 |
| C | 588 | 216 | 77 | 82 | 5 | 0.20 | 93 |

In this table and the following ones, R indicates ultimate tensile strength, $R_s$ yield strength, A elongation and Z reduction of area in the tensile test. Grain measurement is by ASTM number.

As is evident Practice C, as per the present invention, permits attainment of results that are absolutely comparable with those of the conventional practice (B), but with a considerable energy saving.

The corrosion rate was measured as per ASTM A-262, Practice C. Less than 0.6 mm/year is considered as good corrosion resistance.

Drawability was measured by the reduction of cross-section area during drawing. Values in excess of 90% are considered excellent.

EXAMPLE 2

A 9.5 mm diameter wire rod of AISI 304 steel (C 0.040%, Cr 18.4%, Ni 10.3%) was hot rolled with a finishing rolling temperature of 1000° C. It was then treated as per Practices A, B and C of Example 1. The properties of the products obtained were as follows:

TABLE 2

| | R(MPa) | $R_s$(MPa) | A % | Z % | ASTM grain n° | Intergranular corrosion rate mm/yr | Upsettability index ho/hi |
|---|---|---|---|---|---|---|---|
| A | 610 | 256 | 58 | 75 | 10 | 5.1 | Broke immediately |
| B | 516 | 190 | 73 | 79 | 4–5 | 0.18 | 6.8 |
| C | 525 | 198 | 72 | 80 | 5 | 0.21 | 6.9 |

The upsettability index is the ratio of the original height of the testpiece (ho) to that reached when the first crack appears (hi).

EXAMPLE 3

An AISI 316 steel (C 0.036%, Cr 16.9%, Ni 11.9%, Mo 2.37%) was hot rolled to 11 mm diameter wire rod with a finishing rolling temperature of 1035° C. The wire rod was then treated in the following ways:

(D) Water cooled from finishing rolling temperature (E) As per (B)

(F) Placed in furnace at 1050° C. and held for fifteen minutes; water cooled.

The properties of the products obtained are set forth in Table 3.

TABLE 3

| | R(MPa) | $R_s$(MPa) | A % | Z % | ASTM grain n° | Intergranular corrosion rate mm/yr | Upsettability index ho/hi |
|---|---|---|---|---|---|---|---|
| D | 660 | 340 | 54 | 71 | 12 | 1.00 | 5.5 |
| E | 540 | 230 | 66 | 77 | 5–6 | 0.97 | 7.1 |
| F | 538 | 220 | 69 | 78 | 5 | 0.96 | 7.4 |

The corrosion rate was measured as per ASTM A-262, Practice D. A corrosion rate of $R \leqq 1$ is considered good.

EXAMPLE 4

An AISI 430 ferritic steel (C 0.025%, Cr 17.2%) was hot rolled to 6 mm wire rod, with a finishing rolling temperature of 860° C. and then treated in the following ways:

(G) Air cooled (H) Air cooled; heated in furnace to 800° C. and held for one hundred and twenty minutes; water cooled (I) Placed in furnace at 840° C. and held for thirty minutes; water cooled.

The properties of the products obtained are set forth in Table 4.

TABLE 4

| | R(MPa) | $R_s$(MPa) | A % | Z % | ASTM grain n° | Intergranular corrosion rate mm/year | Drawability % |
|---|---|---|---|---|---|---|---|
| G | 694 | 405 | 32 | 74 | 10 | 31 | Broke |
| H | 540 | 305 | 44 | 79 | 10 | 4.8 | 84 |
| I | 465 | 270 | 45 | 83 | 10 | 5.0 | 84 |

In this case the corrosion rate was measured as per ASTM 763, Practice X, for which a rate of less than 10 mm/year is considered acceptable.

As is evident, this invention ensures results that are absolutely comparable with those provided by the conventional treatment methods, but with considerably lower energy consumption.

The invention has been described by particular reference to some specific forms of embodiment, but it is understood that modifications and variations can be made by experts in this field, without going beyond the relevant protection.

We claim:

1. A process for heat treatment of austenitic and ferritic stainless steel wire rod, comprising the following steps:

rolling a said stainless steel wire rod with a finishing-rolling temperature (FRT) between 850° C. and 1050° C.;

immediately thereafter holding said rod at a temperature between FRT −50° C. and FRT +100° C. for 2 to 30 minutes; and water cooling the rod.

2. A process as claimed in claim 1, in which said holding at a temperature is for 15 to 30 minutes.

* * * * *